US011828129B1

(12) United States Patent
Rogers et al.

(10) Patent No.: US 11,828,129 B1
(45) Date of Patent: Nov. 28, 2023

(54) PLUG CONTAINER, METHOD AND APPARATUS

(71) Applicant: Citadel Casing Solutions, LLC, Houston, TX (US)

(72) Inventors: Henry E. Rogers, Collinsville, OK (US); Nicolas Rogozinski, Evergreen, CO (US)

( * ) Notice: Subject to any disclaimer, the term of this patent is extended or adjusted under 35 U.S.C. 154(b) by 0 days.

(21) Appl. No.: 17/166,269

(22) Filed: Feb. 3, 2021

(51) Int. Cl.
*E21B 33/068* (2006.01)
*E21B 34/02* (2006.01)

(52) U.S. Cl.
CPC ..... *E21B 33/068* (2013.01); *E21B 34/02* (2013.01)

(58) Field of Classification Search
CPC ..... E21B 34/02; E21B 33/068
See application file for complete search history.

(56) References Cited

U.S. PATENT DOCUMENTS 3,777,819 A * 12/1973 Delano ..... E21B 19/00 166/285
4,574,882 A * 3/1986 Szarka ..... E21B 33/05 166/70
4,995,457 A * 2/1991 Baldridge ..... E21B 17/05 166/70
5,095,988 A * 3/1992 Bode ..... E21B 21/10 137/268
5,443,122 A * 8/1995 Brisco ..... E21B 33/05 166/285
8,997,850 B2 * 4/2015 Barbee ..... E21B 33/068 166/70
9,341,040 B2 * 5/2016 Barbee ..... E21B 33/05
2003/0024701 A1 * 2/2003 Simson ..... E21B 33/16 166/291
2020/0157909 A1 * 5/2020 Fernandes ..... E21B 34/02

* cited by examiner

*Primary Examiner* — Aaron L Lembo
(74) *Attorney, Agent, or Firm* — Avek IP, LLC

(57) ABSTRACT

A wellbore plug container includes a body with an interior to house a lower plug and an upper plug; a manifold system in fluid communication with the interior of the body; a first valve assembly to direct fluid flow into the interior of the body; and a second valve assembly to direct fluid flow into the interior of the body; a tubular connection to connect the body and manifold system to a casing for use with a wellbore; fluid flow is first directed below the lower plunger via the manifold system; the lower plunger assembly is retracted in a second step and fluid flow is directed to below the upper plunger assembly and above the lower plug, thereby causing the lower plug to launch; and fluid flow is diverted to above the upper plug after retraction of the upper plunger assembly in a third step to launch the upper plug.

5 Claims, 9 Drawing Sheets

PLUG CONTAINER, METHOD AND APPARATUS

BACKGROUND

1. Field of the Invention

The present invention relates generally to well drilling operations, and more specifically to an apparatus and method of use for surface cementing operations where conventional surface launch cementing plugs are used.

2. Description of Related Art

Wellbore systems are well known in the art and are effective means to collect resources for energy use.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
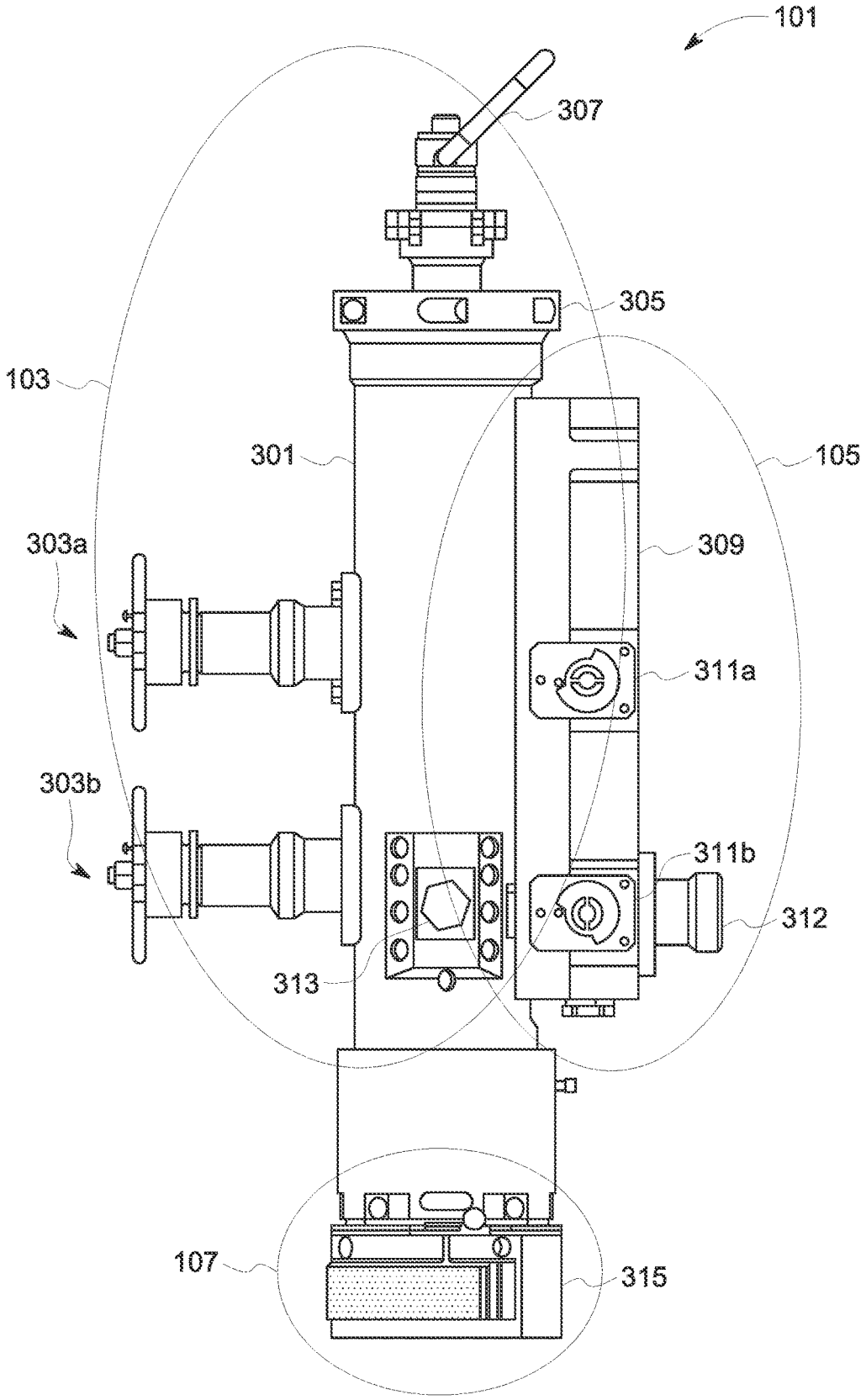
FIG. 1 is a front view of a preferred embodiment of the apparatus of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-10 depict various views of an apparatus 101 in accordance with a preferred embodiment of the present application.

In the contemplated embodiment, apparatus 101 includes three primary components, namely a body and plungers 103, a manifold system 105, and a tubular connection 107. It should be appreciated that the three primary components are broken up and explained herein, however, these components provide for novelty and improvement over the prior art.

Specifically, the body and plunger portion are where cementing plugs are installed and located during the circulation operations of a well drilling operation. The cementing plugs remain in this portion of the head until the plungers are retracted, and the fluid is diverted into the manifold to launch the plug into the casing.

The manifold is a system is in fluid communication with the interior of the body and is a configuration of flow paths that can be manipulated to direct fluid flow to a location on the body that is desired by the operator. Specifically, the fluid flow is initially directed below the lower plunger assembly. Wherein a second step involves retracting the lower plunger assembly, and the flow is directed to below the upper plunger assembly and above the lower cementing plug. It should be understood that the change in fluid flow serves to launch the lower cementing plug from the cement head. In a third step, this process is repeated to divert the flow to below the cap and above the upper cementing plug after retracting the upper plunger assembly. This serves to launch the upper cementing plug into the casing of the wellbore operation. It should be appreciated that the steps above are completed with the manifold system, wherein the manifold system opens and closes valves as commanded to create the needed fluid flow.

The tubular connection is used to adjoin the plug container body to the casing mechanically with a hydraulic seal with said casing to enable pressure pumping operations to be performed.

It should be appreciated that one of the unique features believed characteristic of the present application is the combination of the above three primary features.

Figure 2A:
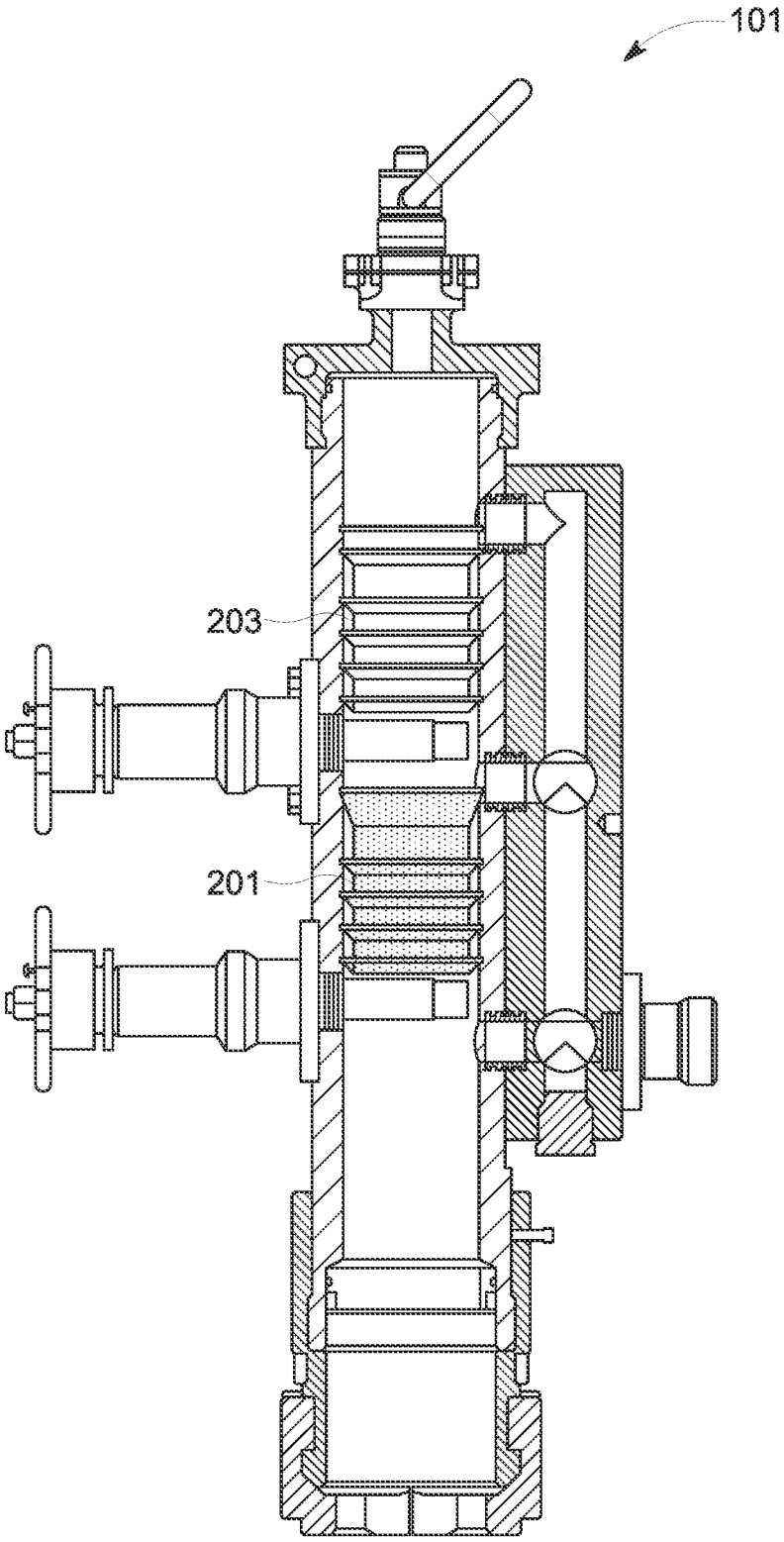
FIGS. 2A, 2B, and 2C are front views depicting use of the apparatus of FIG. 1 for launching plugs.
Figure 2B:
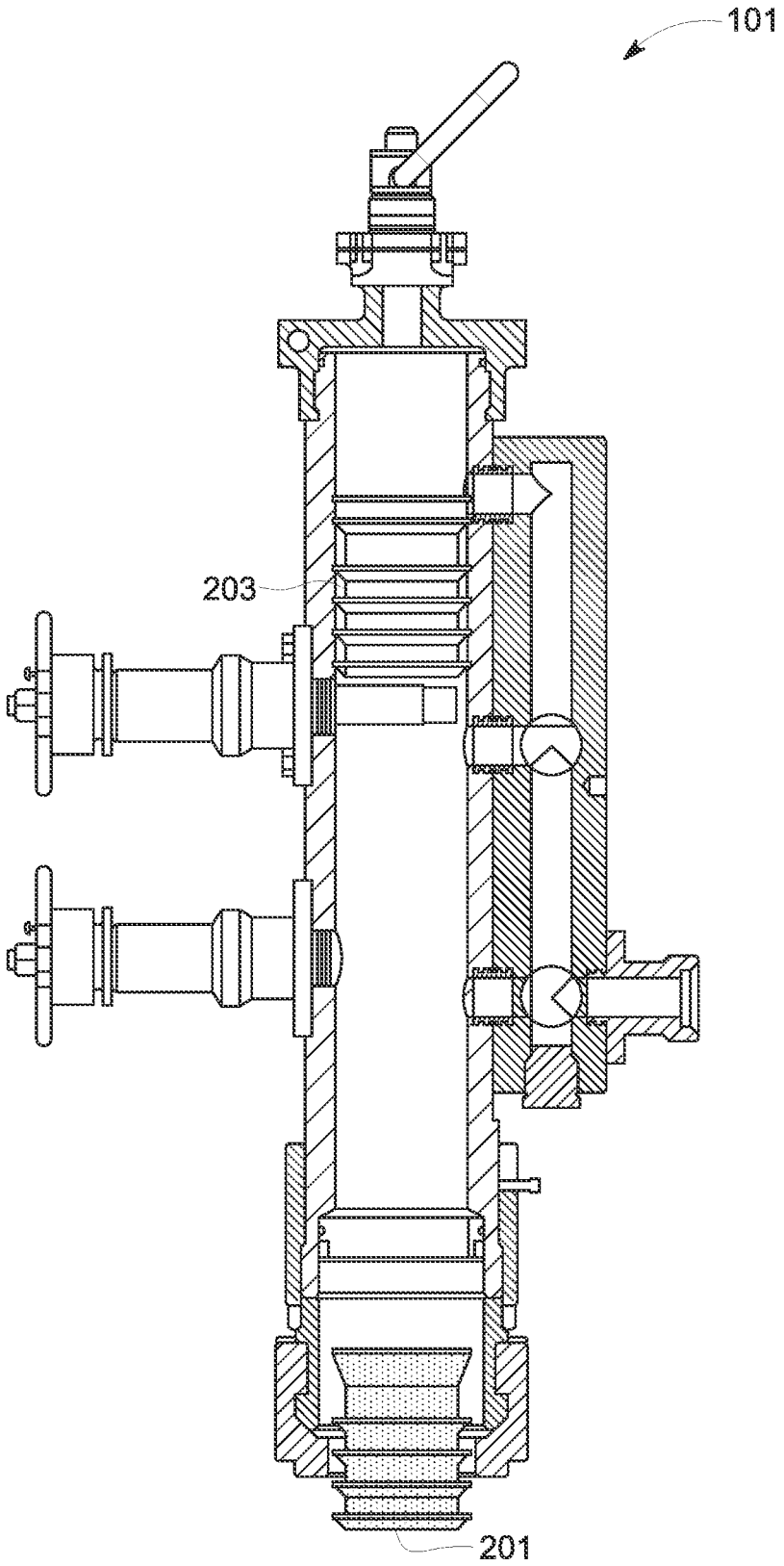
Figure 2C:
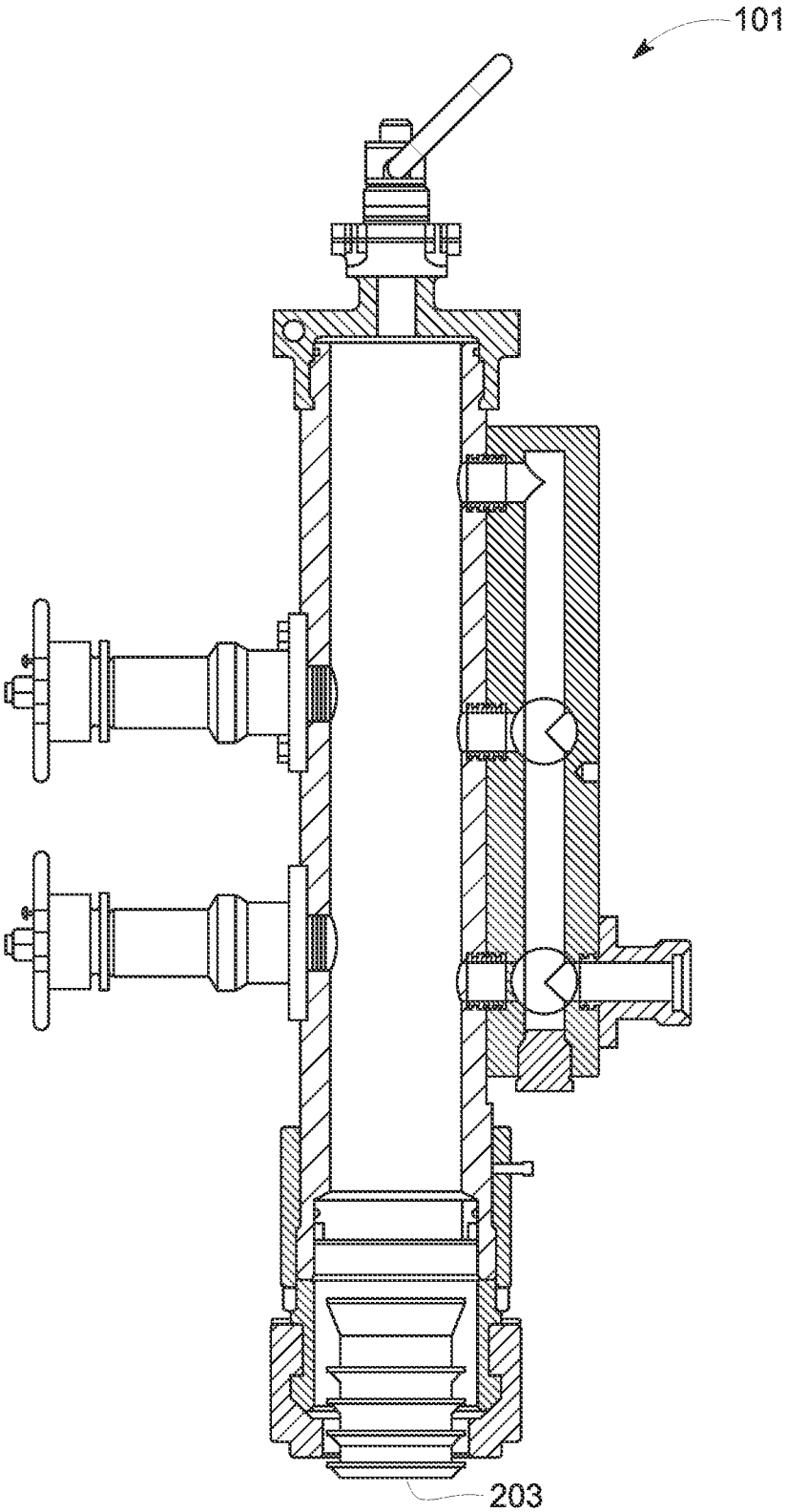

In FIGS. 2A, 2B, and 2C, a series of three front views depicts the process of launching cement plugs through apparatus 101. As shown in the first image, fluid is diverted to circulation. As shown in the second image, fluid is then diverted to release the bottom plug 201 by being diverted to above the bottom plug 201 and below the upper plug 203. As shown in the third image, the fluid flow is then diverted to below the cap and above the upper plug 203 to release the upper plug.

Referring back to FIG. 1, a front view of apparatus 101 is shown with details. Apparatus 101 including a main body 301 with upper and lower plunger assemblies 303*a-b* attached thereto. The upper plunger assembly 303*a* extends from the side of the body at a position higher than the lower plunger assembly 303*b* as shown. As shown, and should be appreciated, the plunger assemblies extend into the interior of the body, wherein the plugs 201, 203 are housed.

The body 301 further includes a plug container cap 305 positioned at the top end of the body and a hoist ring 307 positioned above the container cap. The manifold includes a manifold body 309 bolted onto the main body 301 with upper and lower manifold valve assemblies 311*a-b* with a handle for actuating the valve assemblies. As shown, the valves are configured to direct fluid flow into the interior of the body at two different positions. The manifold further including a 2-inch 1502 thread 312 for flow iron bolted onto the body. Further included is a cementing plug launch indicator 313 bolted onto the main body and a coupler clamp assembly 315 threaded onto the main body.

Another unique feature believed characteristic of the present invention is the manifold assembly 105. The manifold assembly is fabricated from steel that is machined to create flow paths that are managed with valves that divert the fluid flow to a desired path. This manifold assembly provides for a simple and efficient operation when compared to the prior art. Further, using a monoblock assembly reduces the number of leak paths common to manifolds that are assembled from numerous individual pieces assembled together to make a manifold assembly.

Figure 3:
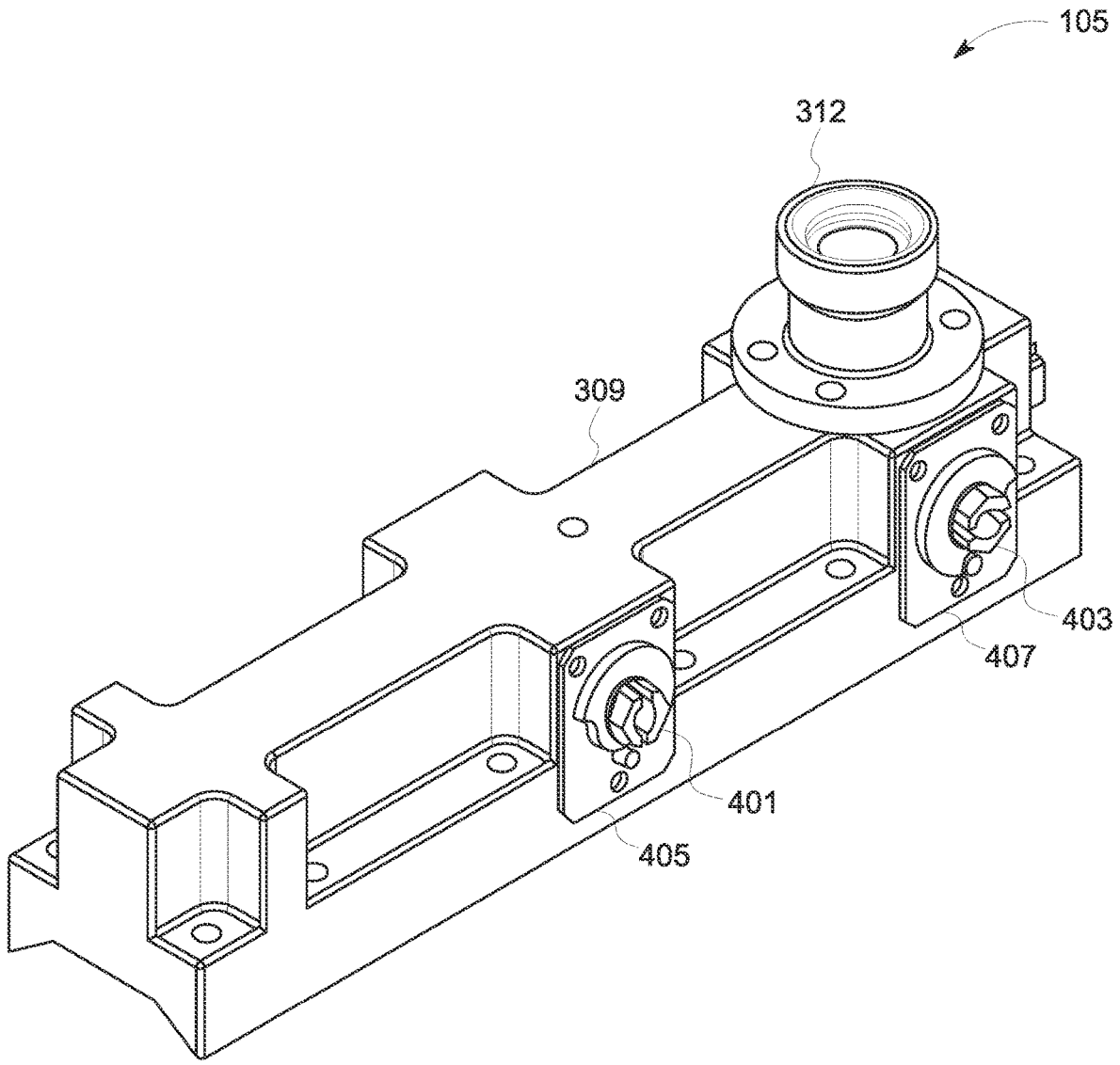
FIG. 3 is an isometric view of a manifold of the apparatus of FIG. 1.
Figure 4:
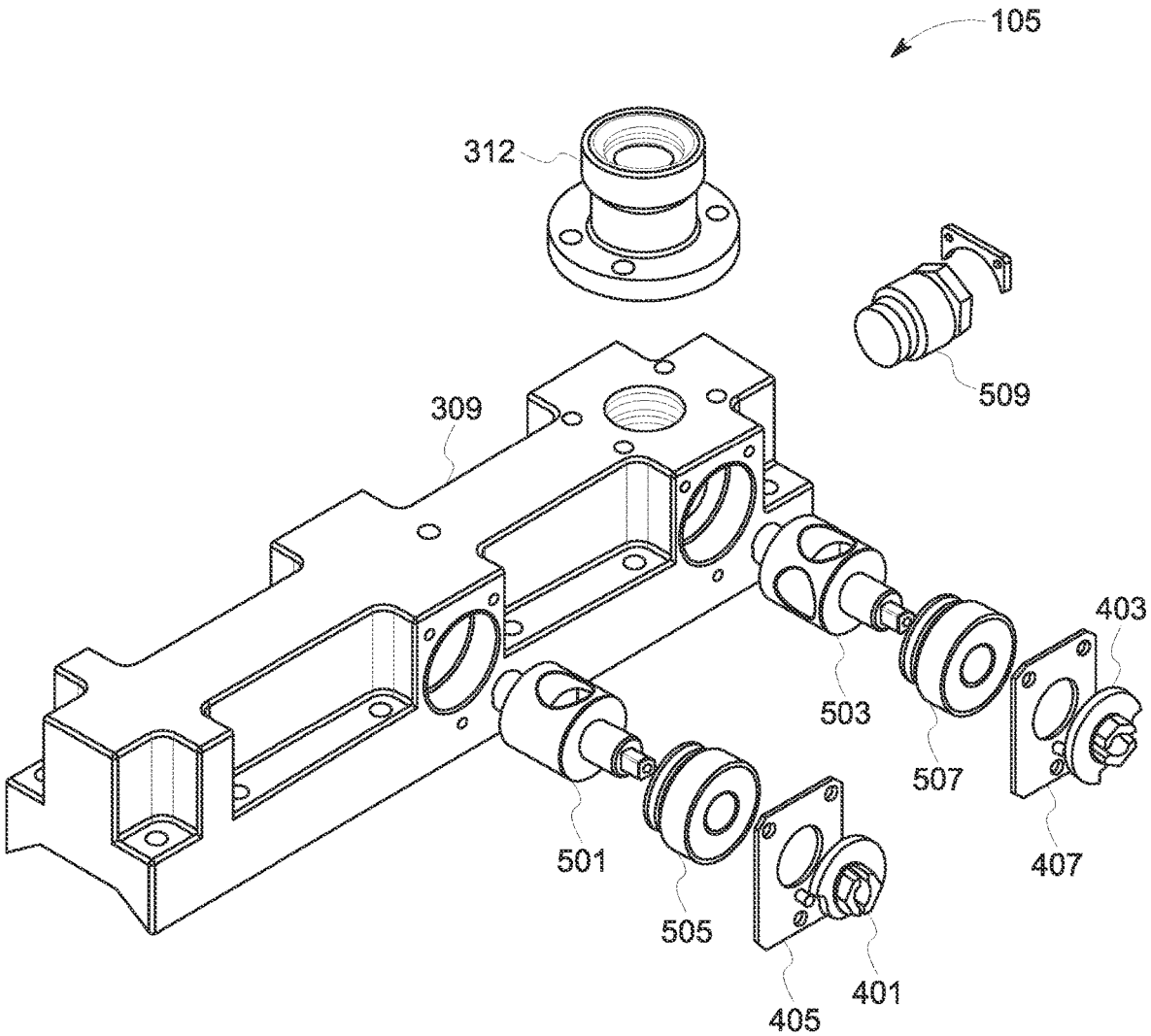
FIG. 4 is an isometric exploded view of the manifold of FIG. 3.

The manifold assembly and components therefore are shown and described in FIGS. 3-4. As shown in FIGS. 3 and 4, the manifold assembly includes the manifold body 309 with the 2-inch 1502 thread connection 312 wherein pumping equipment would can connect to the manifold. Valve assemblies include handles 401, 403 configured to engage with valves 501, 503 through cover plates 405, 407 and valve nuts 505, 507. Additionally, there is a manifold bore plug 509. It should be appreciated that the manifold could be configured with additional valves. The valves aid in directing and diverting flow within the manifold body.

Figure 5:
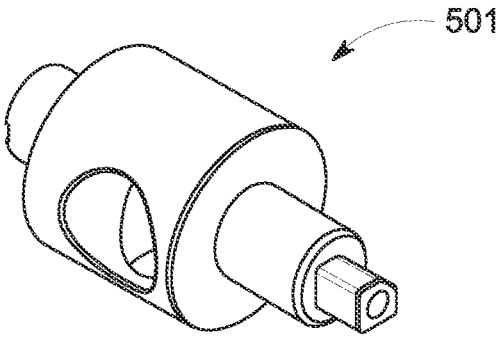
FIG. 5 is an isometric view of a manifold valve used in the manifold of FIG. 3.
Figure 6:
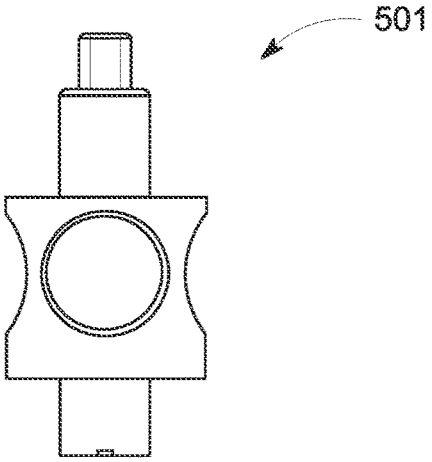
FIG. 6 is a side view of the manifold valve of FIG. 5.
Figure 7:
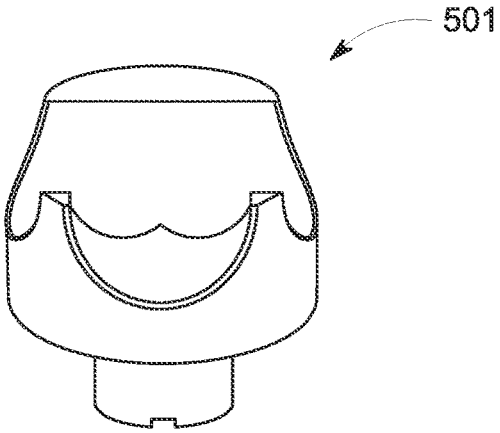
FIG. 7 is a cut away view of the manifold valve of FIG. 5.

In FIGS. 5-7, various views of a valve 501 are shown in accordance with the present invention. In the preferred embodiment, the valve is a hydraulically balanced valve with identical shaft diameters on both ends.

Figure 8:
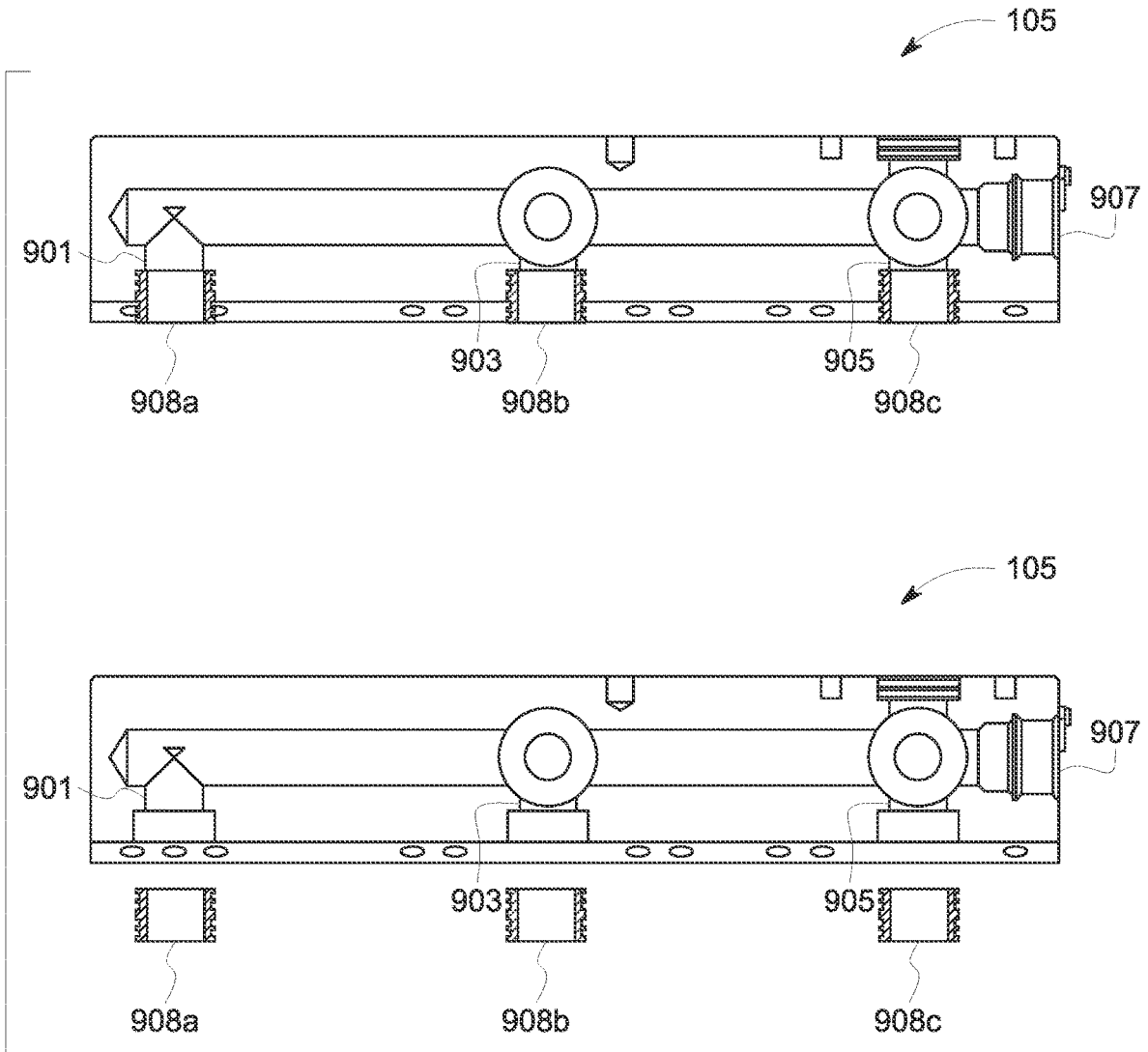
FIG. 8 is a side view of the manifold of FIG. 3.

In FIG. 8, a simplified side view depicts the manifold assembly 105 flow paths, namely an upper manifold flow path 901, an upper valve and middle flow path 903, a lower valve and lower flow path 905, and a thread for manifold bore plug 907. Further included is a plurality of spacer tubes 908*a-c* that provide for connection between manifold 105 and body 301.

Figure 9:
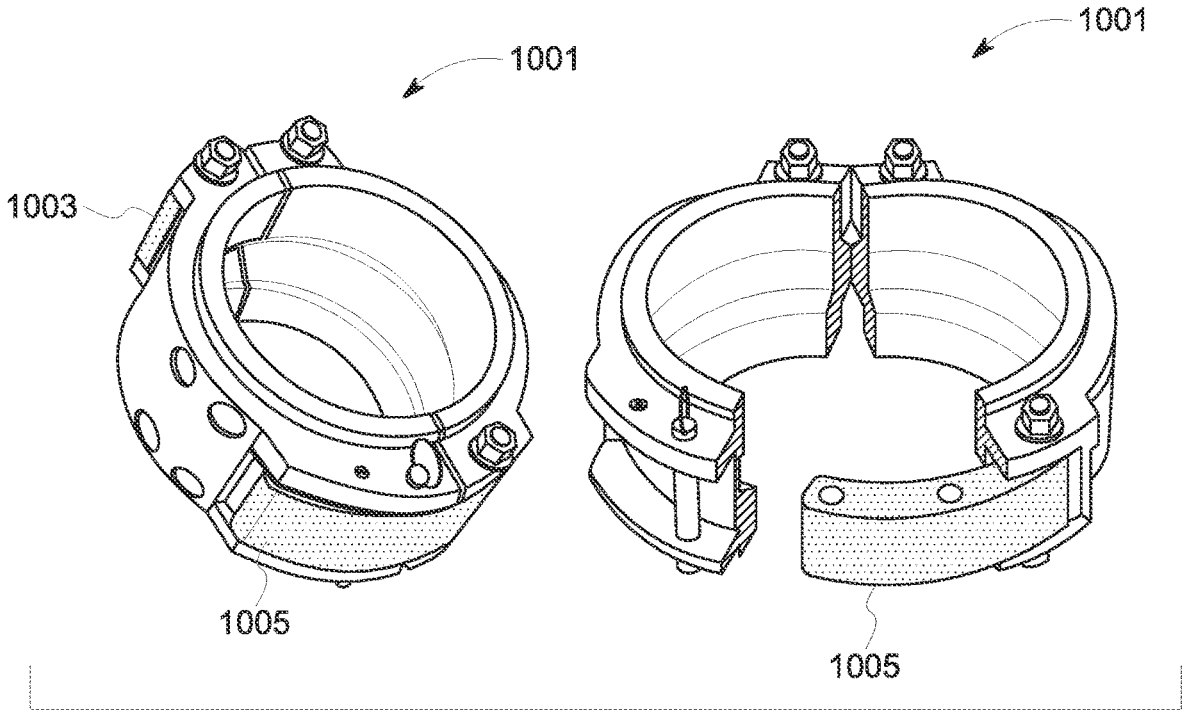
FIG. 9 shows an isometric closed and open view of a coupling clamp of the apparatus of FIG. 1.

In FIG. 9, a coupling clamp 1001 in accordance with the present invention is shown. The coupling clamp 1001 is configured to adjoin to a casing during wellbore operations. The coupling clamp 1001 includes a hinge 1003 and a latch 1005 to allow for opening and closing.

Figure 10:
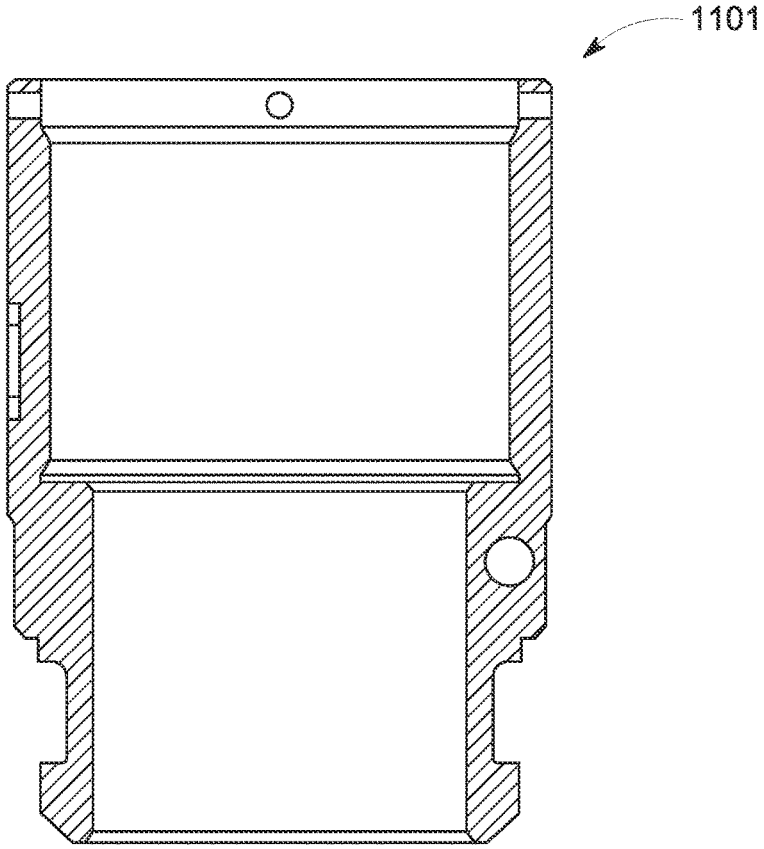
FIG. 10 is a side view of an adjustable nut used with the coupling clamp of FIG. 9.

In FIG. 10, an adjustable nut 1101 is shown, the adjustable nut being configured to adjust the coupling clamp latch length to allow for the coupling clamp latch to mate with various casing coupling lengths.

The apparatus of the present invention provides for benefits over the prior art, namely, the manifold block enables the use of fewer connections, thus reduces the number of leak paths common to a conventional manifold system; the manifold block allows 90° rotation of a single valve to divert fluid flow from one path to a second path; the manifold block allows the center of gravity to me moved closer to the plug container body, thus eliminate the need for lift chains or a leveling bar; the manifold block creates a less costly and more easily maintainable manifold system compared to a conventional valve manifold system; the non-welded coupling clamps improve the fabrication of and the long-term maintenance of the clamps by using the dual pin hinge to eliminate welds.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wellbore plug container, comprising:

a body with an interior to house a lower plug and an upper plug, the body having:

an upper plunger assembly extending from a side of the body;

a lower plunger assembly extending from the side of the body at a position lower than the upper plunger assembly;

the upper and lower plunger assemblies extending into the interior of the body and providing physical blocking of the lower plug and the upper plug when extending into the interior of the body;

a manifold system having a manifold body and in fluid communication with the interior of the body, the manifold system having:

the manifold body is monolithic such that the manifold body forms a central channel extending from a top end to a bottom end and a plurality of secondary channels extending perpendicular to the central channel and connecting the central channel to the interior of the body, the manifold body having a first opening and a second opening;

a flow path in fluid communication with the interior of the body at a location above the upper plug when the upper plug is physically blocked by the upper plunger assembly such that directed fluid will act upon the upper plug;

a first valve assembly configured to direct fluid flow into the interior of the body at a first position, the first position being directly below the upper plunger assembly, the first valve assembly having a first valve extending through the first opening of the manifold body into the central channel and operated by a first handle accessible on an exterior of the manifold body;

a second valve assembly configured to direct fluid flow into the interior of the body at a second position, the second position being directly below the lower plunger assembly, the second valve assembly having a second valve extending through the second opening of the manifold body into the central channel and operated by a second handle accessible on the exterior of the manifold body;

a connection extending from the manifold body at a position below the first valve assembly, the connection is configured to attach to a piece of pumping equipment for receiving fluid therefrom and directing the fluid therefrom in functional order, to the central channel of the manifold body, then through an open one or more of the first valve assembly and the second valve assembly, and then into the interior of the body through one of the plurality of secondary channels;

a tubular connection configured to connect the body and manifold system to a casing for use with a wellbore;

wherein fluid flow is first directed below the lower plunger via the second valve assembly being in an open position and via the manifold system, the first valve assembly being in a closed position;

wherein the lower plunger assembly is retracted in a second step and fluid flow is directed to below the upper plunger assembly and above the lower plug via the first valve assembly being in an open position, thereby causing the lower plug to launch; and wherein fluid flow is diverted to above the upper plug via the first flow path after retraction of the upper plunger assembly in a third step, such that the fluid flow acts directly upon the upper plug to launch the upper plug; and wherein the manifold body directly provides for fluid flow into the body without additional connecting components.

2. The plug container of claim 1, wherein the body further comprises:

a container cap positioned at a top end of the body; and a hoist ring positioned above the container cap.

3. The plug container of claim 1, wherein the manifold system further comprises:

the first valve assembly having a handle engaged with a valve and configured to open and close the valve.

4. The plug container of claim 1, further comprising:

a coupler clamp assembly threaded onto the body at a bottom end.

5. The plug container of claim 1, further comprising:

a plug launch indicator attached to the body.

* * * * *